US007191062B2

(12) United States Patent
Chi et al.

(10) Patent No.: US 7,191,062 B2
(45) Date of Patent: Mar. 13, 2007

(54) METHOD AND SYSTEM OF FORECASTING COMPACTION PERFORMANCE

(75) Inventors: Liqun Chi, Dunlap, IL (US); Paul T. Corcoran, Washington, IL (US); Susan B. Grandone, Queensia (AU)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 11/017,514

(22) Filed: Dec. 20, 2004

(65) Prior Publication Data

US 2005/0158129 A1 Jul. 21, 2005

Related U.S. Application Data

(60) Provisional application No. 60/532,206, filed on Dec. 22, 2003.

(51) Int. Cl.
*G01N 9/36* (2006.01)
*G06F 19/00* (2006.01)

(52) U.S. Cl. ..... 702/2; 702/137

(58) Field of Classification Search ..... 702/2, 702/11, 3, 12, 137, 167, 168, 182, 187, 188
See application file for complete search history.

(56) References Cited

U.S. PATENT DOCUMENTS 4,467,652 A 8/1984 Thurner AB et al.
4,979,197 A 12/1990 Troxler, Sr. et al.
5,177,415 A 1/1993 Quibel et al.
5,471,391 A 11/1995 Gudat et al.
5,493,494 A 2/1996 Henderson
5,942,679 A 8/1999 Sandstrom
6,122,601 A 9/2000 Swanson et al.
6,460,006 B1 10/2002 Corcoran
6,859,732 B2 * 2/2005 Tritico et al. ..... 702/2

FOREIGN PATENT DOCUMENTS

DE 3421824 A1 12/1985
DE 29723171 U1 6/1998
EP 0761886 A1 3/1997
RU 1806244 A3 3/2003
SU 1761864 A1 9/1992
WO WO 94/25680 11/1994

* cited by examiner

*Primary Examiner*—Donald McElheny, Jr.
(74) *Attorney, Agent, or Firm*—W. Bryan McPherson; Finnegan, Henderson, Farabow, Garrett & Dunner

(57) ABSTRACT

The present invention is associated with a system and method of managing a compaction process. The method may include establishing a soil characteristic and establishing a machine performance characteristic in response to the soil characteristic. The machine performance characteristic may include a predictive compaction characteristic associated with a particular machine.

20 Claims, 4 Drawing Sheets

METHOD AND SYSTEM OF FORECASTING COMPACTION PERFORMANCE

This application claims the benefit of prior provisional patent application Ser. No. 60/532,206 filed Dec. 22, 2003.

TECHNICAL FIELD

This invention relates generally to a method and system of managing soil compaction, and more particularly to a method and system of predicting a predicting a compaction characteristic associated with a soil region.

BACKGROUND

Soil compaction is a time consuming and labor intensive process.

In general, bids will be solicited for jobs involving soil compaction. The solicitor will generally specify a desired compaction density for the soil region to be compacted. Because soil compaction is so resource intensive, underestimating the effort (time, resources etc.) needed to compact a particular region can have significant economic impact on the contractor winning the job. However, there is not an adequate method for predicting the effort and resources needed to perform soil compaction, e.g., what machines are capable of performing the compaction etc. In addition, while there are some systems that exist today that provide feedback during the compaction process, there is not a system that adequately uses the feedback to coordinate the compaction process with multiple machines.

The present disclosure is directed towards solving one or more of the problems set forth above.

SUMMARY OF THE INVENTION

In one aspect of the present invention, a method of managing soil compaction is disclosed. The method includes the steps of determining a site-specific soil characteristic, and determining a machine performance characteristic based on the site-specific soil characteristic.

In another aspect of the present invention, a system configured to manage soil compaction is disclosed. The system includes a processor configured to determine a site-specific soil characteristic and determine a machine performance characteristic based on the site-specific soil characteristic. The system also includes a user interface to receive information associated with the soil, and a display configured to display one or more of the soil and machine performance characteristics.

DETAILED DESCRIPTION

Figure 1:
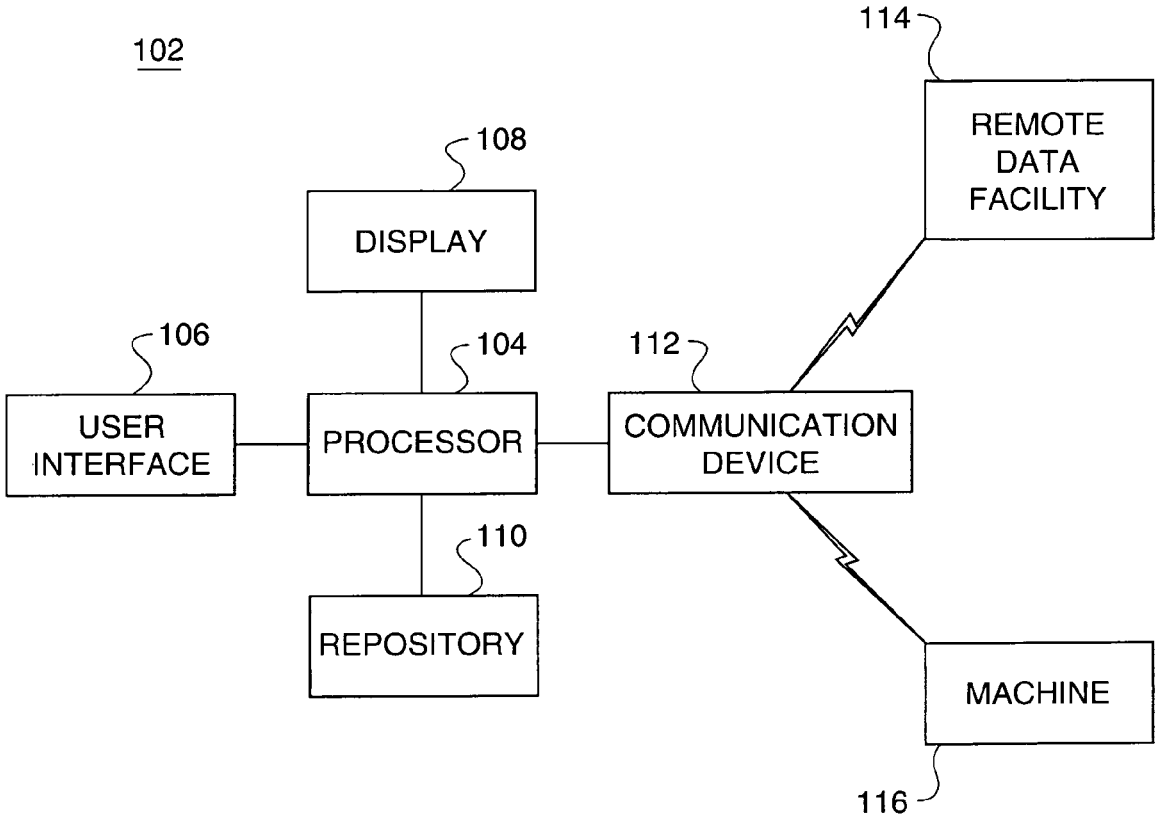
FIG. 1 illustrates one embodiment of a system configured to manage a compaction process.

The present disclosure includes a system and method of managing soil compaction. FIG. 1 illustrates one embodiment of a system 102 configured to manage soil compaction. The system 102 may include a controller 104 configured to establish a site-specific soil characteristic and establish a machine performance in response to the site-specific soil characteristic. The system 102 may also include a user interface 106 configured to receive inputs associated with the soil compaction from a user, and a display 108 configured to display information associated with the soil compaction. In addition, the system 102 may include a repository 110 configured to store information associated with the soil compaction. For example, the database may include data associated with previously analyzed soil. The data may include lab analysis of the soil, compaction predictions associated with the soil, and actual compaction characteristics associated with the soil. As will be described below, the system 102 may include a communication device 112 configured to communicate with a remote entity regarding the soil compaction. Examples of the remote entity include a remote data facility 114, or one or more machines 116 involved in the compaction process. The communication device 112 includes a wireless communication network and/or a landline. For example, the system 102 may communicate compaction information to a machine involved in the compaction process. In addition, the system 102 may include a web-based interface such that users at the remote data facility or compaction machine may access the web site and obtain desired compaction information.

Figure 2:
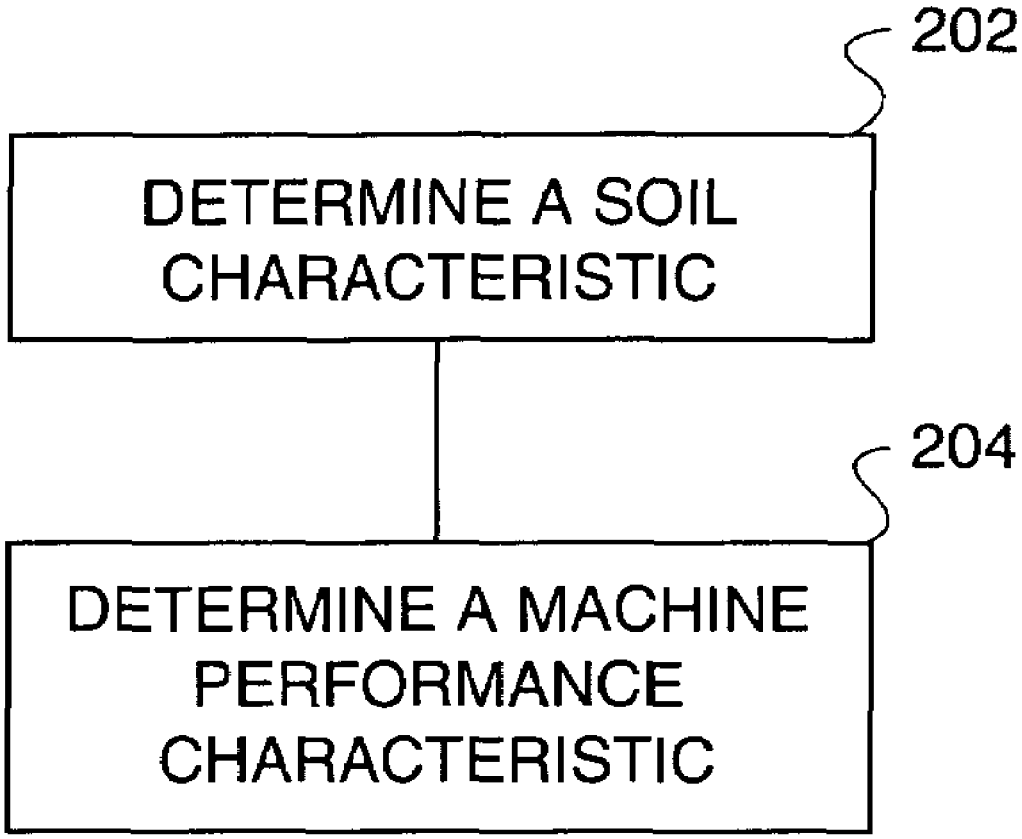
FIG. 2 illustrates one embodiment of a method of managing a compaction process.

FIG. 2 illustrates one embodiment of the method associated with the present disclosure. In a first control block 202 a soil characteristic (e.g., a site specific soil characteristic) may be determined. In one embodiment, a soil characteristic may be determined by taking one or more physical soil samples at the site to be compacted and analyzing the sample(s). The soil characteristics may include a composition characteristic of the soil and/or a predictive compaction characteristic of the soil. The analysis may include one or more procedures to determine a predictive compaction characteristic of the soil. For example the procedures may include a Proctor analysis to determine a predictive compaction density of the particular soil as a function of water content. As will be discussed, other procedures may include determining compaction density as a function of energy level and water content. For example, instead of analyzing a predictive compaction density of the soil at a single energy level, multiple energy levels and multiple water density levels are used to establish more detailed predictive compaction density associated with the soil.

Figure 3:
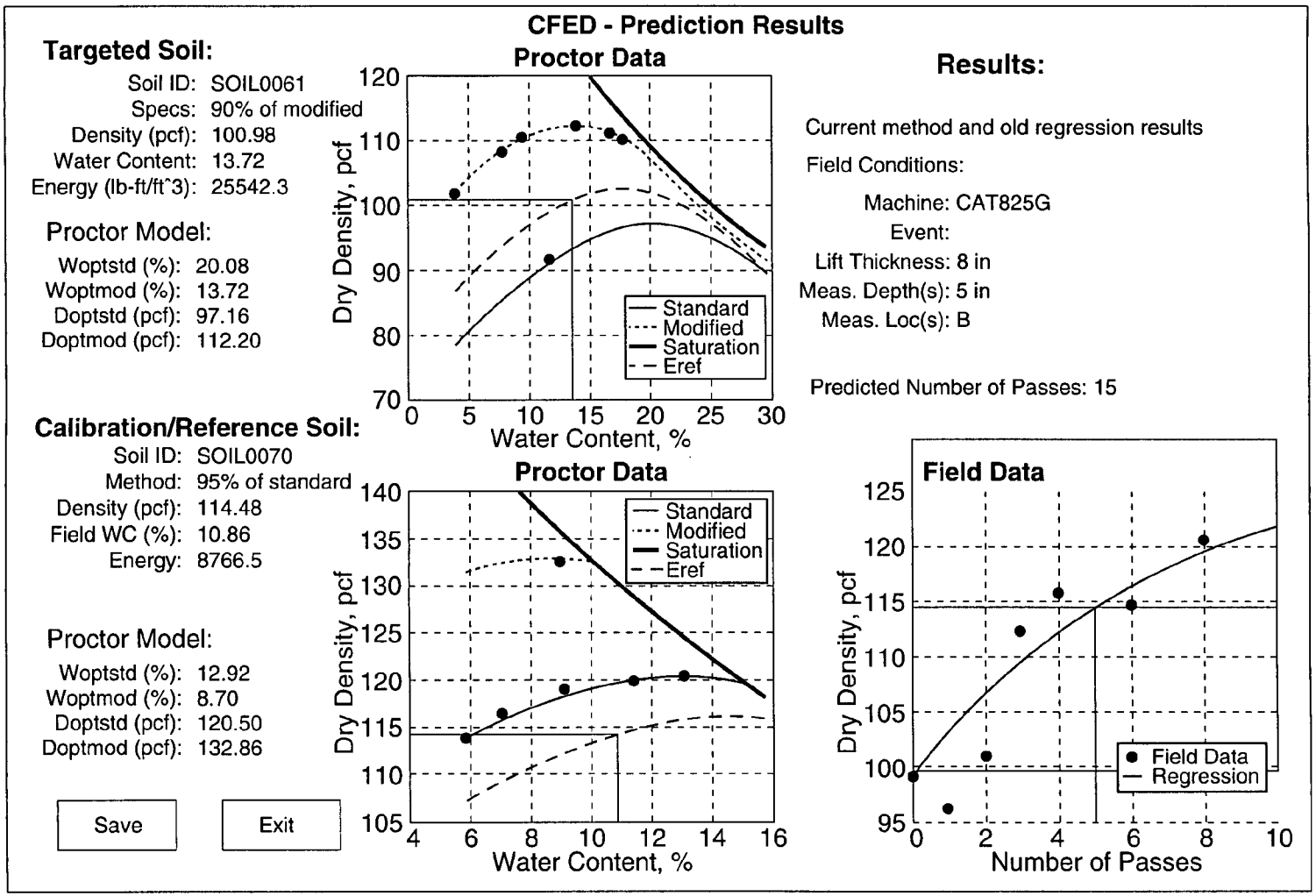
FIG. 3 illustrates a display showing soil characteristics of a current soil, a reference soil and actual compaction characteristics of the reference soil.

In one embodiment, the predictive compaction density characteristics of the soil may be further enhanced by comparing the current soil sample characteristics to previously sampled soil. Information associated with previously sampled soil may be maintained in a repository. The stored information may include the soil characteristics of the soil, the predictive compaction characteristics of the soil, the procedures used to establish the predictive characteristics, and/or actual compaction characteristics of the soil. Therefore, soil characteristics of the sampled soil may be compared with soil characteristics of previously sampled soils. The comparison may identify the previously sampled soil having soil characteristics most similar to the currently sampled soil. The actual compaction characteristics of the previously sampled soil (the reference soil) may be used to establish, or refine, the predictive compaction characteristics of the current soil. For example, interpolation and/or extrapolation factors may be established for the current soil by comparing the reference soil characteristics to the current soil characteristics. The factors may then be used to establish predictive compaction characteristics of the current soil based on the actual compaction characteristics of the reference soil. FIG. 3 illustrates a display showing the soil characteristics of the current soil, the reference soil and actual compaction characteristics of the reference soil.

Figure 4:
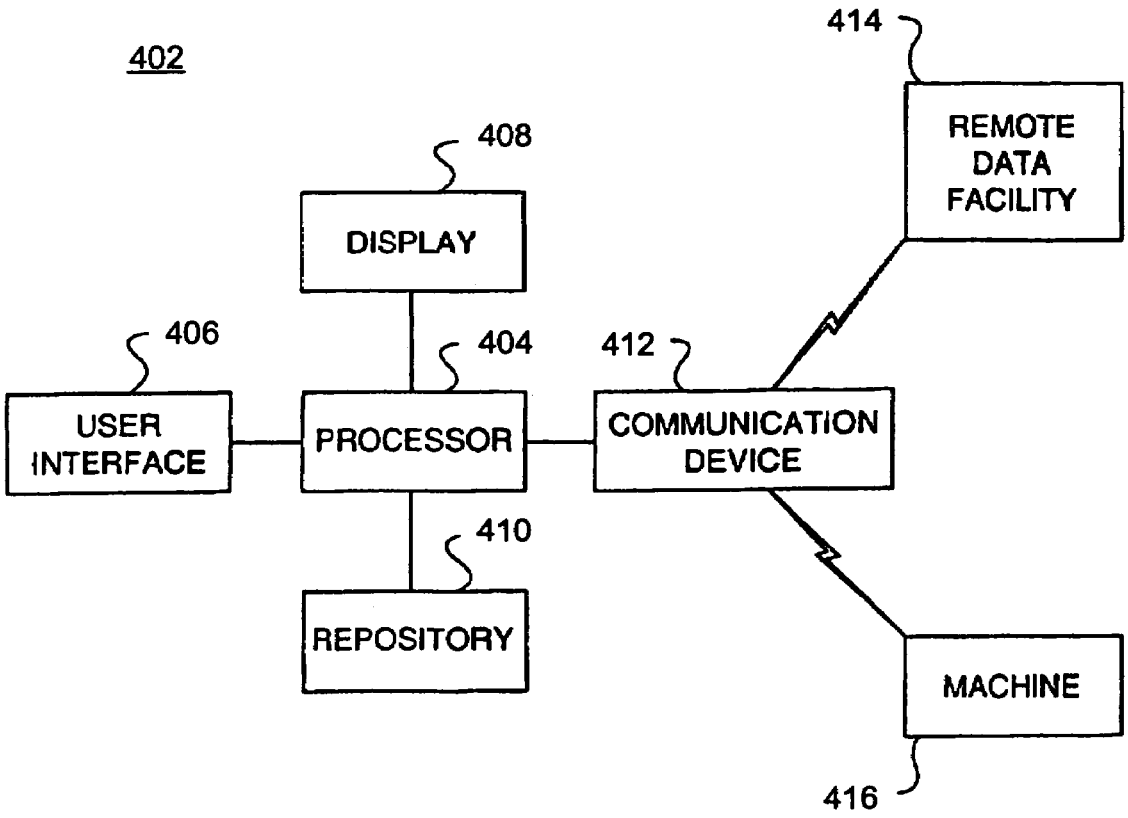
FIG. 4 illustrates a machine being selected for analysis via the user interface, and analyzed in light of the soil characteristics

In a second control block 204, a machine performance characteristic may be determined in response to the site-specific soil characteristic. Machine performance characteristics may include determining whether the soil can be compacted to a specified level, what machine characteristics may be needed to compact the soil to a specified level, whether a given machine may compact the soil to the specified level, recommending a desired machine from a plurality of machines to compact the soil, determining how many passes a given machine will need to compact the soil, determining a confidence level of achieving a specified compaction density. For example, the system 102 may establish a desired compaction density (e.g., the user may establish this). The system 102 may then establish whether the soil can be compacted to that density based on the soil characteristics (e.g., the predictive compaction characteristics of the soil), and also what machine characteristics may be needed (or desired) to compact the soil to the desired density. The machine characteristics may include machine energy dissipation characteristics such as the machine weight, machine roller size, whether the machine has vibratory compaction capability etc. The system 102 may establish values for these desired characteristics, or ranges of values. For example, the system 102 may establish that in order to compact the soil to the desired density, a machine of a particular weight class is necessary, with a particular roller size, and whether the machine needs to include vibratory compaction capability. In an alternative embodiment, information about a particular machine, or group of machines may be provided to the system 102 (e.g., either through the database or entered by the user), and the system 102 may analyze the machine(s) to determine which one, if any will be able to compact the soil to the desire density. FIG. 4 illustrates a machine being selected for analysis via the user interface, and analyzed in light of the soil characteristics. In one embodiment, the system 102 may review a list of machines and determine which one or more of the machines may be able to compact the soil to the desired density. The list may include the machines provided by one or more manufacturers and/or the machines that are owned or available to a particular user. The system may then recommend which one or more of the machines may be able to compact the soil as desired.

In one embodiment, machine performance characteristics may include productivity characteristics, or compaction process characteristics. Examples of compaction process characteristics may include the desired speed to be used by a particular machine to achieve the desired compaction density of the designated soil, an amount of time needed by a particular machine to achieve the desired compaction density, a number of passes needed by a particular machine to achieve the desired density, and a confidence level that a particular machine will achieve the desired compaction density in a particular number of passes.

In one embodiment, the machine performance characteristics are determined by establishing the soil characteristics and establishing one or more desired compaction characteristics, such as a desired compaction density, a desired lift thickness, the number of desired lifts, the number of desired mats. Based on the soil characteristics, the system 102 may determine whether the desired compaction characteristics are obtainable, with what confidence, and by what machine.

In one embodiment, the established soil characteristic and desired compaction density may be used to determine compaction process characteristics such as the desired lift thickness, the number of lifts, and whether any soil additives are needed to achieve the desired compaction density. In one embodiment, when a particular machine is being reviewed to determine whether it is capable of compacting the soil to the desired density, additional factors may be accounted for as mentioned above, such as whether any soil additives are needed to help achieve the desired density, the number of lifts that are needed for this particular machine etc.

As mentioned above, in one embodiment, the system 102 may select a machine to perform the compaction. For example, the system may predict a compaction performance of one or more machines based on the soil characteristics and the machine performance characteristics. The machine that is predicted to achieve the desired compaction would be recommended. If no machine is predicted to achieve the desired compaction, the system may notify the user of this. In one embodiment, the system may perform additional analysis to assess whether the addition of soil additives, changes in lift thickness, or changes in moisture content would result in one or more of the machines being able to achieve the desired compaction. If so, the system may recommend the machine achieving the desired compaction and notify the user of the additional compaction process characteristics needed to achieve the compaction. If multiple machines are able to achieve the desired compaction, then additional analysis may be performed to recommend a particular machine based on predicted compaction results, and productivity characteristics. For example, a machine that weighs more may have more operational costs (e.g., fuel costs, maintenance cost etc.) associated with it than a lighter machine. If both can achieve the desired compaction, then the machine having lower operating cost may be recommended. Other productivity characteristics that may be accounted for include the speed at which a machine can go, the width of the roller, the number of passes needed by the machine etc.

Therefore, compaction performance characteristics and/or productivity characteristics of designated machines may be used to recommend a machine to compact a specified soil or soil region.

In one embodiment, the system 102 may determine additional compaction process characteristics such as whether multiple machines may be useful to perform the desired compaction, the compaction routes of the recommended machines, the speed of the machines etc. For example, the area to be compacted may be provided to the system 102, e.g., based on GPS coordinates etc. Based on the designated area, and the established soil characteristics, the system may determine if different types of compaction machines would be useful (e.g., if there are variations in the soil characteristics in the region), and determine the number of machines that may be used to compact the soil region. The system 102 may use desired productivity information to determine how many machines should be working in a compaction region at a given time. For example, the system may determine if different machine sizes may be useful in compacting the soil (to address variations in soil composition), and also whether multiple machines may useful to achieve the desired productivity characteristics.

The system 102 may designate desired routes of the machines (e.g., designate compaction zones or areas for particular machines), and the number of passes each machine will need. Therefore the system is capable of performing route planning and route management. As will be discussed below, as the actual compaction is occurring, measurements may be dynamically taken that will enable the designated routes/passes to be updated while compaction is in progress.

In one embodiment, the machine performance characteristics may be updated based upon a rainfall that occurred after the soil sample(s) was taken.

This update may enable a more reliable prediction regarding compaction capability. In addition, the compaction prediction, including machine selection, may be reviewed in light of a current moisture level, or predicted rainfall etc. For example, in bid analysis, predicted rainfall may be used to plan the compaction process, e.g., the type(s) of machines needed, the impact of rain on achieving the desired compaction density etc. If the soil sample was taken in a dry season, and compaction is to occur in a more humid or rainy season, then this may be taken into account with productivity and compaction predictions, based on the sensitivity of the ability to compact the soil to moisture, and the ability of a machine to compact the soil based on the moisture content.

The established soil characteristics, machine performance characteristics, and/or the productivity characteristics may be used to manage the compaction process. In one embodiment, as illustrated in FIG. 4, a system 402, which may be on-board and/or off board, may be used to monitor the actual compaction process. The system 402 may include hardware and software on the machine performing the compaction, and may also include a remote facility, such as system 102, and or a second remote facility 404. For example, the system 402 may be able to determine the current compaction density, and from that predict how many additional passes will be needed, and update the compaction route and characteristics etc.

The system may be able to dynamically determine whether the desired compaction density is achievable based on machine characteristics. In addition, the system may be able to identify portions of the compaction region that are not compacting as predicted, and also make additional compaction recommendations, such as update the prediction regarding the number of passes it will take to achieve the desired level, or make recommendations regarding locally applying soil additives to a particular region. In one embodiment, the system may recommend that a second machine compact a particular portion of the soil region. For example, if, during compaction, the system determines that there is a hot region (e.g., a region that is not compacting as predicted), the system 402 (or one of the remote systems) may determine that a second machine (e.g., a heavier machine and/or a vibratory compactor etc.) may be used to compact the specified hot region. The system may communicate directly, or indirectly with the second machine to notify it of the designated hot region, and communicate appropriate compaction characteristics, e.g., how many times the hot region has been passed over, and with what machine, what the current compaction characteristics of the zone are, and what the desired compaction density of the zone is etc.

INDUSTRIAL APPLICABILITY

The present disclosure includes a system and method of managing soil compaction. The method includes the steps of determining a soil characteristic and determining a machine performance characteristic in response to the soil characteristic. In one embodiment, one or more soil samples may be taken at a site that is desired to be compacted. Soil characteristics may be established based on the soil samples. The soil characteristics may include composition properties of the soil and predictive compaction characteristics of the soil. A user may enter desired compaction characteristics into the system 102, such as desired compaction density etc. The user may request that a machine be recommended that is capable of achieving the desired compaction characteristics. The system 102 may responsively recommend one or more machines capable of achieving the desired compaction characteristics. In one embodiment, the system 102 may recommended multiple machines to accomplish the compaction, assign compaction routes to the machines, and predict productivity characteristics associated with the machines. In one embodiment, these route assignments may be delivered to compaction machines, and used by the machines (or operators of the machine) to begin compaction.

As the region is being compacted, machine parameters may be sensed that will enable an actual compaction characteristic to be established. For example, the system (either the on-board system or a remote system) may determine the actual compaction that has occurred, compare the actual with the predicted compaction and update the compaction characteristics accordingly. For example, if the soil is not compacting as fast as predicted, the system may determine that more passes will be needed by the current machine. Alternatively the system may determine that the current machine will not be able to achieve the desired compaction results for a particular region, e.g., a hot region. The system may notify a second machine that is capable of dissipating more energy into the soil to compact the identified hot region. Alternatively, or in addition, the system may determine that soil additives need to be used on the hot region, establish the amount and type of additives needed, and then communicate the information to machines having the additives, or operators/managers able to have the additives delivered to the designated region. In this manner, the system is able to dynamically monitor and respond to the compaction process as it occurs.

Other aspects, objects, and advantages of the present invention can be obtained from a study of the drawings, the disclosure, and the claims.

What is claimed is:

1. A system for managing soil compaction comprising:

a user interface configured to receive inputs associated with a desired soil compaction from a user;

a controller configured to determine a machine performance characteristic based on a measured site specific soil characteristic;

a module to determine a compaction data related to at least one of the desired soil compaction, the machine performance characteristic, and the site specific soil characteristic;

a communication device configured to communicate the compaction data to one or more machines; and at least one remote module configured to be installed in at least one machine and configured to communicate with the communication device and direct the at least one machine to compact soil to the desired soil compaction in response to the communicated compaction data.

2. The system of claim 1, wherein the communication device is configured to communicate with a remote data facility.

3. The system of claim 1, wherein the communication device Includes at least one of a wireless communication network and a landline.

4. The system of claim 1, wherein the module Includes a database to store the site specific soil characteristics and machine performance characteristic.

5. The system of claim 4, wherein the database further Includes data related to previously analyzed soil.

6. The system of claim 1, wherein the site specific soil characteristic includes a compositional characteristic of the soil.

7. The system of claim 1, wherein the machine performance characteristic includes an energy dissipation characteristic of the at least one machine.

8. The system of claim 7, wherein the energy dissipation characteristic includes at least one of machine weight, roller size, and vibratory characteristics.

9. The system of claim 1, wherein the module is configured to recommend a type of machine to be used for soil compaction based upon at least one of the site specific soil characteristic and the machine performance characteristic.

10. The system of claim 9, wherein the type of machine includes characteristics of the machine including at least one of machine weight, machine roller size, and machine vibratory compaction capability.

11. The system of claim 10, wherein the module is further configured to determine a travel route and number of passes for each of the machines.

12. The system of claim 1, wherein the controller is configured to update the machine performance characteristic based on dynamic measurements of the site specific soil characteristic during a compacting event.

13. A method for managing soil compaction including the steps of:

providing a desired soil compaction level;

measuring a site specific soil characteristic;

determining a machine performance characteristic based on the measured site specific soil characteristic;

storing the site specific soil characteristic and the machine performance characteristic in a database;

predicting a compaction level based on at least one of the site specific soil characteristic, the machine performance characteristic, and the desired soil compaction level;

communicating the predicted compaction level to at least one machine; and compacting soil to the desired soil compaction level with the at least one machine in response to the predicted compaction level.

14. The method of claim 13, further including recommending one or more machines for soil compaction based on the predicted compaction level.

15. The method of claim 14, wherein recommending one or more machines includes factoring in machine operational costs.

16. The method of claim 14, wherein recommending the one or more machines includes selecting machines from a plurality of different types of machines.

17. The method of claim 16, wherein determining the predicted compaction level further includes providing a travel route and a number of passes for each machine.

18. The method of claim 13, further including wirelessly communicating the predicted compaction level to the one or more machines.

19. The method of claim 13, wherein predicting the compaction level is based on performing dynamic measurements of the site specific soil characteristic during a compaction event.

20. The method of claim 13, wherein predicting the compaction level further includes recommending soil additives needed to achieve the desired soil compaction level.

* * * * *